252-99 AU 165 EX
6/8/76 XR 3,962,149

United States Patent [19]
Chirash et al.
[11] 3,962,149
[45] June 8, 1976

[54] NON-PHOSPHATE SPRAY DRIED DETERGENTS CONTAINING DICARBOXYLIC ACID SALTS

[75] Inventors: William Chirash, New Providence; Alfred Edgar Haase, Fanwood; Andrew Henry Limekiller, Belle Mead, all of N.J.

[73] Assignee: Colgate-Palmolive Company, New York, N.Y.

[22] Filed: Oct. 12, 1973

[21] Appl. No.: 406,015

[52] U.S. Cl. ..... 252/540; 252/89 R; 252/99; 252/135; 252/174; 252/559; 252/DIG. 1; 252/DIG. 11; 252/DIG. 12

[51] Int. Cl.[2] ..... C11D 1/83; C11D 3/20; C11D 11/02; C11D 17/06

[58] Field of Search ..... 252/89, 99, 132, 135, 252/539, 540, 174, 559

[56] References Cited

UNITED STATES PATENTS

| | | | |
|---|---|---|---|
| 2,878,190 | 3/1959 | Dvorkovitz | 252/540 X |
| 3,425,948 | 2/1969 | Otrhalek | 252/539 X |
| 3,519,570 | 7/1970 | McCarty | 252/135 |
| 3,658,727 | 4/1972 | Mast | 252/538 |
| 3,661,787 | 5/1972 | Brown | 252/109 |
| 3,692,684 | 9/1972 | Hentsche | 252/Hentschel |
| 3,714,051 | 1/1973 | Milesi | 252/135 |
| 3,723,327 | 3/1973 | VanKampen | 252/110 |
| 3,776,851 | 12/1973 | Cheng | 252/89 |
| 3,817,870 | 6/1974 | Weiss | 252/135 |
| 3,844,969 | 10/1974 | Griffiths | 252/108 |
| 3,849,327 | 11/1974 | DiSalvo | 252/109 |

*Primary Examiner*—Dennis L. Albrecht
*Attorney, Agent, or Firm*—Kenneth A. Koch; Murray M. Grill; Herbert S. Sylvester

[57] ABSTRACT

A spray dried, non-phosphate, substantially unbuilt detergent bead composition post treated with non-ionics, comprising approximately by weight, (a) 2–30% of a dibasic acid component, (b) up to 35% of an anionic, zwitterionic or amphoteric detergent material, (c) up to 5% of a ionic surfactant, (d) 0 to 7% of an alkali metal silicate, the balance being filler.

18 Claims, No Drawings

NON-PHOSPHATE SPRAY DRIED DETERGENTS CONTAINING DICARBOXYLIC ACID SALTS

This invention relates to a novel spray dried presoak laundry detergent composition and to the method of making same. More particularly, the invention relates to a non-phosphate composition which is produced by having post added thereto a quantity of non-ionic surfactant. The invention additionally contemplates the post addition of said non-ionic to a base composition including either a non-ionic, anionic, amphoteric or zwitterionic surfactant. In certain embodiments the detergent will also contain an active enzyme ingredient and where desired optional ingredients.

In recent years laundry pre-soak detergent compositions have found widespread acceptance due to their unique ability to be applied either only directly to the area to be cleaned or because of their ability to more effectively loosen and dislodge stubborn stains. Oftentimes, the mere application of a laundry pre-soak will be sufficient in removing the stain.

Notwithstanding their uniqueness, however, the laundry pre-soaks have fallen into some disfavor in that they generally contain objectionable builders, the latter presently under fire for ecological reasons.

Attempts to eliminate the phosphate builders from pre-soaks have not met with particular success, especially where the pre-soak composition is a spray dried bead.

Heretofore attempts to eliminate phosphate builders from conventional spray dried laundry pre-soak products have encountered the drawback that substantial amounts of sodium silicate and sodium carbonate be incorporated therein in place of said phosphate. The incorporation of the latter two agents was heretofore necessary in order to permit the manufacture of spray dried beads that were reasonably free flowing and resistant to degradation (i.e. disintegration) during handling and storage. These prior art compositions contained as much as 8% by weight of each of said two agents in order that the above requirements could be met. This high level of alkalinity, however, necessitates the employment of an acid to partially neutralize the product so as to maximize overall stain removal ability. It has been found that absent such a reduction in soak solution pH, many oxidizable stains such as tea and berry stains are set or even darkened and thereafter the pre-soak solution has for all intents and purposes a rather limited effectiveness. By lowering the soak solution pH from about 10 or higher to about 8, oxidizable stains are reduced in intensity while the enzymatic action against responsive stains and salts is retained.

It has now been found that a satisfactory non-phosphate-builder pre-soak product can be obtained by replacing the high alkaline builder components and the neutralizing acid such as citric acid, necessarily employed along therewith, by an appropriate amount of a dibasic acid component, more particularly a salt thereof. The salt is believed to function not as a builder but rather as an agent operative to accomodate the increased over spray (by post addition) of functional levels of non-ionic surfactants onto a spray dried detergent base. Elimination of the alkaline builder salt and the neutralizing acid represents a substantial economic savings as well as providing for the production of a free-flowing, substantially strong, integral bead.

The present invention offers the possibility of removing all of the non-ionic detergent from the crutcher mix, if desired, and over spraying it onto the spray dried base bead. This process eliminates the substantial pluming of the non-ionic above the spray tower exhaust stack, and accordingly from an environmental point of view is more satisfactory than heretofore employed methods of incorporating substantial amounts of non-ionic surfactants into a detergent base composition. From an economic point of view, it represents a further cost savings in that loss of the volatile non-ionic is substantially eliminated during the spray drying operation. Due to the costly nature of most non-ionics, this advantage in and of itself justifies the instant invention. The method also permits the incorporation of greater amounts of non-ionics into a spray dried detergent bead inasmuch as absent post addition to the spray dried product, generally only about 2% non-ionic can be incorporated into the detergent composition. Post adding said non-ionic to either a low non-ionic content containing bead or another suitable surfactant bead base provides yields of non-ionics up to amounts of about 5%.

The invention contemplates post adding the non-ionic to the spray dried bead subsequent to removal of the bead from the tower. Other agents such as enzymes, perfumes, optical brighteners, colorants and the like may also be added subsequent to spray drying in any order, i.e., either prior to, or contemporaneous with or subsequent to the post addition of the non-ionic to the detergent base bead.

Post-spraying rather than spray drying the nonionic with the crutcher mix, is practiced because otherwise the non-ionic detergents may tend to collect on the surfaces of the atomized particles being spray dried and may make them sticky, causing them to lump together at the bottom of the tower, especially when they are warm, as they are when first deposited there. Also, the nonionic detergents are often liquid, semi-soft or in gel-like form at some of the temperatures obtaining in the spray tower and frequently will be vaporized, flashed or fumed out of the tower, thereby being lost and giving rise to objectionable air pollution as aforesaid. For these reasons crutcher mixes to be spray dried contain relatively small proportions of nonionic detergents, if any at all are present. Most of such compound(s) being added to the above pre-soak composition is sprayed onto the surfaces of tumbling beads of inorganic builder salt and/or detergent base in a drum or tubular vessel, possibly together with perfume. Powdered ingredients, where employed, such as anti-redeposition agents and flow improving agent may also be added at this time.

Broadly speaking, the invention includes the provisions of a spray dried, non-phosphate, substantially unbuilt detergent bead composition post treated with non-ionics comprising approximately by weight, (a) 2–30% of a dibasic acid component, (b) up to 35% of an anionic, zwitterionic or amphoteric detergent material, (c) up to 5% of a non-ionic surfactant, (d) 0 to 7% of an alkali metal silicate, the balance being filler. The invention also includes a process for preparing the above composition comprising admixing components (a), (b), (c) and (d), and spray drying same to form a bead and thereafter treating the resulting beads with a nonionic surface-active agent.

The present invention further contemplates employing a normally liquid or semi solid non-ionic detergent to produce a laundry pre-soak detergent composition, so that the bulk density of the spray dried beads is in the range of 0.2 to 0.6 gram/cc. In practice, there is admixed with a 40 to 75% solids content aqueous crutcher mix containing the base content material, from 2 to 30% of dibasic acid component and spray drying the resulting mixture, preferably with the crutcher mix being sprayed at a temperature of 90° to 190°F., preferably about 100° to 135°F.

The base content beads as they are referred to, normally will comprise up to about 35% of a surfactant material to which there will thereafter be added the nonionic; ordinarily the amount of surfactant (other than non-ionic) present in the base bead will be about 0.1–20%, preferably 3–15% of one of the surfactants earlier mentioned. Naturally, where the base bead is comprised solely of a non-ionic surfactant, the latter will only be present prior to overspray in amounts of about 2%.

The compositions that are produced in accordance with the present invention may also include sodium silicate in amounts up to about 7%. The addition of sodium silicate does not substantially affect the preferred pH of the soak solution, so long as same is not employed in too great an amount. It does, however, aid in giving bead integrity to the final product. Zero to up to 7% is permissible, preferably, however, only about 1 of 2% will be employed; at such levels the desired pH of about 7–9 is not affected nor does same interfere with any enzyme that may be present in the composition. While sodium silicate is preferred, other alkali metal silicates may be used. Of the sodium silicates which are employed those having an $Na_2O:SiO_2$ ratio of from 1:1.6 to 1:3.4, preferably from 1:2 to 1:3 and most preferably about 1:2.4, are most favored.

Normally the proportion of dibasic acid component present in spray dried detergent beads will be from 2 to 30%, and for the present processes this is preferably from 5 to 25%, ideally about 8–18%. The balance of such compositions may contain other materials, filler salts, synthetic organic detergents or various adjuvants for such detergent compositions. Generally, the balance will be an inert filler such as sodium sulfate or the like. Such materials are well known in the art.

The dibasic saturated acids contemplated by the instant invention include oxalic, malonic, succinic, glutaric, adipic, pimelic, suberic, azelaic and sebacic. The sodium salts of these acids are preferred, however, other alkali metal acid salts may also be employed. Most preferred are the alkali metal salts of adipic acid and most preferably the sodium salt thereof.

It has been found that it is preferable to use the double salt of one of the foregoing dibasic acids rather than the mono salt thereof. Those skilled in the art will recognize that these salts may be formed in any number of ways and a specific method of formation forms no basis of the instant invention.

Although it is not necessary to have a synthetic organic anionic detergent incorporated in the crutcher mix or in the product after the beads are sprayed, such detergent are frequently desirable constituents of the product because they contribute particular detersive properties to the final composition. Yet, if desired, the active detergent constituent may be solely a nonionic detergent, the greater proportion of which is post-added onto the spray dried beads in a subsequent spraying operation.

Thus, suitable anionic surface active agents include those surface active or detergent compounds which contain an organic hydrophobic group and an anionic solubilizing group. Typical examples of anionic solubilizing groups are sulfonate, sulfate, carboxylate, phosphonate and phosphate. Examples of suitable anionic detergents which fall within the scope of the invention include the soaps, such as the water-soluble salts of higher fatty acids or resin acids, such as may be derived from fats, oils, and waxes of animal, vegetable or marine origin, e.g., the sodium soaps of tallow, grease, coconut oil, tall oil and mixtures thereof; and the sulfated and sulfonated synthetic detergents, particularly those having about 8 to 26, and preferably about 12 to 22 carbon atoms to the molecule.

The anionic detergent is preferably a higher alkyl benzene sulfonate, especially a water soluble salt of a linear higher alkyl benzene sulfonate, e.g., the alkali metal salt or sodium salt of a linear higher alkyl benzene sulfonate. However, other anionic detergents may also be present. Such compounds as well known in the detergent art and are described at length at pages 25 to 138 of the text, *Surface Active Agents and Detergents*, Vol. II, by Schwartz, Perry and Berch, published in 1958 by Interscience Publishers, Inc. Among the most useful anionic compounds so described are the higher alkyl sulfates, the higher fatty acids monoglyceride sulfates, the higher alkyl sulfonates, the sulfated phenoxy polyethoxy ethanols, the branched higher alkyl benzene sulfonates, the higher linear olefin sulfonates, e.g. hydroxyalkane sulfonates and alkenyl sulfonates, including mixtures, higher alkyl ethoxamer sulfates and methoxy higher alkyl sulfates, such as those of the formula $RO(C_2H_4O)_nSO_3M$, wherein R is a fatty alkyl of 12 to 18 carbon atoms, n is from 2 to 6 and M is a solubilizing salt-forming cation, such as alkali metal and

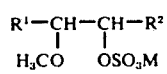

wherein $R^1$ and $R^2$ are selected from a group consisting of hydrogen and alkyls, with the total number of carbon atoms in $R^1$ and $R^2$ being in the range of 12 to 18.

As examples of suitable synthetic anionic detergents there may be cited the higher alkyl mononuclear aromatic sulfonates such as the higher alkyl benzene sulfonates containing from 10 to 16 carbon atoms in the alkyl group in a straight or branched chain, e.g., the sodium salts of decyl, undecyl, dodecyl, (lauryl), tridecyl, tetradecyl, pentadecyl, or hexadecyl benzene sulfonate and the higher alkyl toluene, xylene and phenol sulfonates; alkyl naphthalene sulfonate, ammonium diamyl naphthalene sulfonate, and sodium dinonyl naphthalene sulfonate.

Other anionic detergents are the olefin sulfonates, including long sulfate, alkene sulfonates, long chain hydroxyalkane sulfonates or mixtures of alkenesulfonates and hydroxyalkane sulfonates. These olefin sulfonate detergents may be prepared, in known manner, by the reaction of $SO_3$ with long chain olefins, (of 8–25, preferably 12-21 carbon atoms) of the formula $RCH{=}CHR_1$, where R is alkyl and $R_1$ is alkyl or hydrogen, to produce a mixture of sultones and alkenesulfonic acids, which mixture is then treated to convert the sultones to sulfonates. Examples of other sulfate or sulfonate detergents are paraffin sulfonates, such as the reaction products of alpha olefins and bisulfites (e.g., sodium bisulfite), e.g., primary paraffin sulfonates of about 10–20, preferably about 15–20 carbon atoms; sulfates of higher alcohols; salts of α-sulfofatty esters (e.g., of about 10 to 20 carbon atoms, such as methyl α-sulfomyristate or α-sulfotallowate).

Examples of sulfates of higher alcohols are sodium lauryl sulfate, sodium tallow alcohol sulfate, Turkey Red Oil or other sulfated oils, or sulfates of mono- or diglycarides of fatty acids (e.g. stearic monoglyceride monosulfate), alkyl poly (ethoxy) ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly (ethenoxy) ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate) the acyl esters (e.g. oleic acid ester) of isethionates, and acyl N-methyl taurides (e.g. potassium N-methyl lauroyl-or oleyl tauride).

Of the various anionic detergents mentioned, the preferred salts are sodium salts and the higher alkyls are of 10 to 12 to 18 carbon atoms, preferably of 12 to 18 carbon atoms, except where otherwise mentioned. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxy ethanol (of 30 ethoxy groups per mole); sodium propylene tetramer benzene sulfonate; sodium hydroxy-n-pentadecyl sulfonate; sodium dodecenyl sulfonate; lauryl polyethoxy ethanol sulfate (of 15 ethoxy groups per mole); and potassium methoxy-n-tetradecyl sulfate.

The most highly preferred water soluble anionic detergent compounds are the alkali metal (such as sodium and potassium) and alkaline earth metal (such as calcium and magnesium) salts of the higher alkyl benzene sulfonates, olefin sulfonates, the higher alkyl sulfates and the higher fatty acid monoglyceride sulfates. The particular salt will be suitably selected depending upon the particular formulation and the proportions therein. The foregoing are employed in amounts as mentioned above, i.e., up to 35% by weight.

Although, because of the pluming of the nonionic in the spray tower and the sticking together of the spray dried beads when nonionics are present in the formulation, the presence of nonionic detergents in the crutcher mix will normally be avoided, in accordance with the present invention it has been discovered that either with or without a small percentage of soap in the crutcher mix, the presence of some nonionic allows producing a detergent bead which is of a higher nonionic content than would be obtained in the absence thereof in the crutcher. As does the presence of soap in the crutcher mix, a small proportion of nonionic detergent improves the wetting and detergent properties of the spray dried detergent beads, while not promoting excessive foaming (and often limiting foaming of such compositions).

Nonionic surface active agents include those surface active or detergent compounds which contain an organic hydrophobic group and a hydrophilic group which is a reaction product of a solubilizing group such as carboxylate, hydroxyl, amido or amino with ethylene oxide or with the polyhydration product thereof, polyethylene glycol.

As examples of nonionic surface active agents which may be used there may be noted the condensation products of alkyl phenols (e.g. $C_8$–$C_{20}$ alkyl) with ethylene oxide, e.g., the reaction product of isooctyl phenol with about 6 to 30 ethylene oxide units; condensation products of alkyl ($C_8$ to $C_{20}$ alkyl) thiophenols with 10 to 15 ethylene oxide units; condensation products of higher fatty alcohols (e.g. $C_8$–$C_{20}$) such as tridecyl alcohol with ethylene oxide; ethylene oxide addents of monoesters of hexahydric alcohols and inner ethers thereof such as sorbitan monolaurate, sorbitan monooleate and mannitan monopalmitate, and the condensation products of polypropylene glycol with ethylene oxide.

Of the nonionic detergents, those are preferred which are hydroxy-containing, essentially linear polymers of lower alkylene oxide, such as ethylene and propylene oxides, preferably the former, and generally characterized as higher linear lower alkanols which are normally liquid or semi-solid at room temperature. These include condensation products of higher fatty alcohols with poly-lower alkylene glycols, such as Neodol 45-11, Plurafac B-26 and Alfonic 1618-65. Also useful are the block copolymers of propylene glycol, propylene oxide and ethylene oxide, such as the Pluronics, e.g., Pluronic L-44, and the middle alkyl phenyl polyoxyethylene ethanols, such as those sold as Igepals. In the group of higher linear alkoxy poly-lower alkanol detergents, e.g., Neodol 45-11, the higher linear alkoxy is usually of 10 to 18 or 10 to 16 carbon atoms, most preferably of 12 to 15 carbon atoms, and the poly-lower alkoxy alkanol is one in which the lower alkoxy and alkanol are of 2 to 3 carbons each, with the total of carbon atoms in the poly-lower alkoxy lower alkanol, which is preferably polyethoxy ethanol, being 20 to 30. More preferably, the higher alkoxy is of 14 to 15 carbon atoms and the poly-lower alkoxy lower alkanol is of about 22 carbon atoms. Other nonionic detergents of this general type, also made by Shell Chemical Company, the manufacturer of Neodol 45-11, are also useful when they are of 10 to 18 or 13 to 16 carbon atoms in the higher alkanol and of 20 to 26 carbon atoms in the polyethoxy ethanol portions of the molecule. Such compounds, sold under the trade name Neodol 25-7, most preferably include alkanol portions of 12 to 15 carbon atoms and polyethoxyethanol moieties of about 14 carbon atoms. A similar compound which is more a solvent or surface active agent than a detergent, is the corresponding Neodol 25-3, which is like Neodol 25-7 but contains only 6 carbon atoms in the diethoxyethanol portion of the molecule. Portions of the mentioned nonionics may be replaced by other equivalent compounds and such replacement may be made in part by the Pluronic-type materials which are block copolymers of propylene oxide and ethylene oxide, chain-terminated with propylene glycol; alkyl ($C_7$–$C_9$) phenoxy polyethoxy (6–30 ethoxies) ethanols and mixed polyoxyethylenepolyoxypropylene glycols (Ucons) of sufficient molecular weights to possess detergent or surface active properties. The partial replacement of the higher alkanol poly-lower alkoxy lower alkanols (of the Neodol types) by the other nonionic detergents will normally be limited to from 10 to 40% of the nonionic content.

Cationic surface active agents may also be employed in amounts up to about 35%, as aforesaid. Such agents are those surface active detergent compounds which contain an organic hydrophobic group and a cationic solubilizing group. Typical cationic solubilizing groups are amine and quaternary groups.

As examples of suitable synthetic cationic detergents there may be noted that diamines such as those of the type $RNHC_2H_4XH_2$ wherein R is an alkyl group of about 12 to 22 carbon atoms such as N-2-aminoethyl stearyl amine and N-2-amino-ethyl myristyl amine; amido-linked amines such as those of the type $R^1CONHC_2H_4NH_2$ wherein R is an alkyl group of about 9 to 20 carbon atoms, such as N-2-amino ethyl-stearyl amide and N-amine ethyl myristyl amide; quaternary ammonium compounds wherein typically one of the groups linked to the nitrogen atom are alkyl groups which contain 1 to 3 carbon atoms, including such 1 to 3 carbon alkyl groups bearing inert substituents, such as phenyl groups, and there is present an anion such as halogen, acetate, methosulfate, etc. Typical quaternary ammonium detergents are ethyl-dimethyl-stearyl ammonium chloride, benzyl-dimethyl-stearyl ammonium chloride, trimethyl stearyl ammonium chloride, trimethyl-cetyl ammonium bromide, dimethyl-ethyl dilauryl ammonium chloride, dimethyl-propyl-myristyl ammonium chloride, and the corresponding methosulfates and acetates.

Examples of specific amphoteric detergents which may be employed in amounts up to about 35% are N-alkyl-beta-aminopropionic acid; N-alkyl-beta-imino-dipropionic acid, and N-alkyl, N,N-dimethyl glycine; the alkyl group may be, for example, that derived from coco fatty alcohol, lauryl alcohol, myristyl alcohol (or a lauryl-myristyl mixture), hydrogenated tallow alcohol, cetyl, stearyl, or blends of such alcohols. The substituted aminopropionic and imino-dipropionic acids are often supplied in the sodium or other salt forms, which may likewise be used in the practice of this invention. Examples of other amphoteric detergents are the fatty imidazolines such as those made by reacting a long chain fatty acid (e.g. of 10 to 20 carbon atoms) with diethylene triamine and monohalocarboxylic acids having 2 to 6 carbon atoms, e.g. 1-coco-5-hydroxyethyl-5-carboxymethylimidazoline; betaines containing a sulfonic group instead of the carboxylic group; betaines in which the long chain substituent is joined to the carboxylic group without an intervening nitrogen atom, e.g. inner salts of 2-trimethylaminolauric acid, and compounds of any of the previously mentioned types but in which the nitrogen atom is replaced by phosphorus.

It is to be understood that generally only one of the above surfactants will form the base bead. However, where desirable, combinations thereof are permissable with the proviso that the sum total thereof not be in excess of 35% by weight of the total weight of the finished spray dried product.

Various other constituents, generally referred to as adjuvants, may be present in the crutcher mix or may be post-added to the spray dried product. These include enzymes, sanitizers, e.g., trichlorocarbanilide, coloring agents e.g., dyes and pigments, foam improvers, foam depressants, fungicides, anti-oxidants, stabilizers, perfumes, optical bleaches or fluorescent brighteners, soil suspending agents and soil anti-redeposition agents. With respect to the foregoing adjuvants, it will normally be desirable to limit the anti-redeposition agent content in the crutcher where employed, to about 0.5%, since it has been noted that such materials counteract subsequent sorption of post-sprayed nonionics. The anti-redeposition agents referred to include sodium carboxymethyl cellulose, polyvinyl pyrrolidone, polyvinyl alcohol and similar products known in the art. Similarly, the content of sodium silicate in the crutcher mix will normally also be limited to up to about 7% for the same general reason as well as for the reasons stated earlier. However, both anti-redeposition agent and sodium silicate may be post-added to the product, frequently in conjunction with the post-spraying of the non-ionic surface active agent or detergent and perfume onto the spray dried beads. Also, if desired, powdered flow-improving agent such as magnesium silicate, calcined aluminum silicate, talc or other such agent may be admixed with the spray dried beads. Of course, judgement will be employed so that normally there will not be added to the crutcher mix materials which are objectionably decomposed or vaporized off in the spray drying process, e.g., perfumes, excess nonionic surface active materials, organic solvents.

Optical brighteners which may also be included as above referred to are: coumarin types as illustrated in U.S. Pat. Nos. 2,590,485, 2,600,375, 2,610,152, 2,647,132, 2,647,133, 2,791,564, and 2,881,186, Triazolyl stilbene types as illustrated in U.S. Pat. Nos. 2,668,777, 2,684,966, 2,713,057, 2,784,183, 2,784,197, 2,817,655, 2,907,760 2,927,866 and 2,993,892, Stilbene cyanuric types as illustrated in U.S. Pat. Nos. 2,473,475, 2,526,668, 2,595,030, 2,618,636, 2,658,064, 2,658,065, 2,660,578, 2,666,052, 2,694,064, and 2,840,557, Acylamino stilbene types as illustrated in U.S. Pat. Nos. 2,084,413, 2,468,431, 2,521,665, 2,528,323, 2,581,057, 2,623,064, 2,674,604 and 2,676,982, Miscellaneous types such as shown in U.S. Pat. Nos. 2,911,415 and 3,031,460.

The amount of brightener may be for instance in the range of about 1/20 to 1%, e.g. 1/10 to ½%.

Antibacterial agents may be included in the detergent compositions. Examples of these are halogenated carbanilides, e.g. trichlorocarbanilide, halogenated salicylanilide, e.g. tribromosalicylanilide, halogenated bisphenols, e.g. hexachlorophene, halogenated trifluoromethyldiphenyl urea, zinc salt of 1-hydroxy-2-pyridinethione di- and trichloro hydroxy diphenol ethers e.g. 4,2′4′-20H diphenyl ether and the like (e.g. in amounts in the range of about 1/50 to 2%). The presence of antibacterial agents is particularly desirable in detergents to be used for washing in cool water (e.g. at temperature of 70°, 80° or 100°F).

The composition may also contain soil-suspending agents such as sodium carboxymethyl cellulose or polyvinyl alcohol, or both, or other soluble polymeric materials, such as methyl cellulose (the amount of spray agent being, for example, in the range of about 1/20% to 2%) and antioxidants such as 2,6-di-tert-butylphenol, or other phenolic antioxidant materials (e.g. in amounts in the range of about 0.001 to 0.1%).

Foam boosters may also be present; among these are long chain alkanoic acid amides, such as $C_{12}$–$C_{14}$ alkanoic acid diethanolamide or the corresponding isopropanolamides or monoethanolamides; or $C_{12}$–$C_{15}$ alkyl amine oxides, such as lauryl dimethyl amine oxide.

The compositions (particularly those having a high alkaline reserve) may contain solid ingredients that react with water to form hypochlorite chlorine. Among these are heretocyclic N-bromo and N-chloro imides such as trichlorocyanuric, tribromocyanuric acid, dibromo- and dichlorocyanuric acid, and salts thereof with water-solubilizing cations such as potassium and sodium. Such bleaching agents may be employed in admixtures comprising two or more, such as the material commercially available from the Monsanto Chemical Company under the trade name designation "ACL-66" (ACL signifying "available chlorine" and the numerical designation "66", indicating the parts per pound of available chlorine) which comprises a mixture of potassium dichloroisocyanurate (4 parts) and trichlorisocyanuric acid (1 part). Other N-bromo and N-chloro imides may also be used, such as N-brominated and N-chlorinated succinimide, malonimide phthalimide and naphthalimide. Other compounds include the hydantoins, such as 1,3-dibromo and 1,3-dichloro-5,5-dimethylhydantoin, N-monochloro-C,C-dimethylhydantoin methylene-bis (N-bromo-C,C-dimethylhydantoin); 1,3-dibromo and 1,3-dichloro 5-isobutylhydantoin; 1,3-bromo and 1,3-dichloro 5-methyl-5-ethylhydantoin; 1,3-dibromo and 1,3-dichloro 5,5-diisobutyl-hydantoin; 1,3-dibromo and 1,3-dichloro 5-methyl-5-n-amylhydantoin, and the like. Other useful hypohalite-liberating agents comprise tribromomelamine and trichloromelamine. Dry, particulate, water soluble anydrous inorganic salts are likewise suitable for use such as lithium hypochlorite and hypobromite. The hypohalite-liberating agent, may, if desired, be provided in the form of a stable, solid complex or hydrate, such as sodium p-toluene-sulfo-bromaminetrihydrate, sodium benzene-sulfo-chloroamine-dihydrate, calcium hypobromite tetrahydrate calcium hypochlorite tetrahydrate, etc. Brominated and chlorinated trisodium phosphate formed by the reaction of the corresponding sodium hypohalite solution with trisodium phosphate (and water as necessary) likewise comprise efficacious materials. The bleaching agents may be capable of liberating hypochlorite as well as hypobromite such as, for example, the N-brominated, N'-chlorinated heterocyclic imides, as for example the N-bromo, N'-chlorocyanuric acids and salts thereof, e.g., N-monobromo-N, N-dichlorocyanuric acid, N-monobromo-N-monochlorocyanuric acid, -monobromo-N- potassium N-monobromo-N-monochlorocyanurate; and the N-brominated, N-chlorinated hydantoins, e.g, N-bromo-N-chloro-5,5-dimethyl hydantoin and N-bromo-N-chloro-5-ethyl-5-methyl hydantoin.

The hypohalite-liberating compound may be employed in an amount of from 0.1 to 50% of the composition, e.g. about 0.1 to 25%.

The compositions may contain an alkali metal bromide (e.g. NaBr in amount of ¼ or ½%) to increase the bleach effectiveness on addition of sodium hypochlorite to the wash water.

The instant composition may be used in admixture with peroxygen compounds such as perborates (e.g. sodium perborate tetrahydrate or monohydrate or other perborates such as $LiBO_3 \cdot 2H_2O$, $LiBO_3 \cdot H_2O$, $KBO_3 \cdot \frac{1}{2}H_2O$ or barium or calcium perborates), percarbonates (e.g. sodium percarbonate), perphosphates or persulfates (e.g. oxone, comprising potassium persulfate), e.g. in proportions of about 5 to 50% of the total composition.

Activators for the perborate or other peroxygen compound may also be present. These are a well known class of materials, described for example in a series of articles by Gilbert in Detergent Age, June 1967 pages 18–20, July 1967, pages 30–33, and August 1967 pages 26, 27 and 67. The perborate activators of greatest importance in the practice of this invention are compounds which are percarboxylic acid precursors. As explained by Gilbert, such compounds include such derivatives of carboxylic or carbonic acids (e.g. carbonic acid, acetic, benzoic or m-chlorobenzoic acid, etc.) as their esters, anhydrides (with carboxylic, or phosphonic acids or with acidic phosphate esters) amides, chlorides, nitriles. Among suitable activators are such amides as N,N,N',N'-tetraacetyl ethylenediamine, m-chlorobenzoyl dimethylhydantoin, tetraacetyl glycoluril, and such esters as sodium p-sulfophenyl ethyl carbonate.

In a preferred embodiment the compositions will contain an enzyme such as a proteolytic enzyme which is active upon protein matter and catalyzes digestion or degradation of such matter when present as in linen or fabric stain in a hydrolysis reaction. The enzymes may be effective at a pH range of say about 4–12, and may be effective even at moderately high temperatures so long as the temperature does not degrade them. Some proteolytic enzymes are effective at up to about 8°C and higher. They are also effective at ambient temperature and lower to about 10°C. Particular examples of proteolytic enzymes which may be used in the instant invention include pepsin, trypsin, chymotrypsin, papain, bromelin, colleginase, keratinase, carboxylase, amino peptidase, elastase, subtilisia and aspergillopepidase A and B. Preferred enzymes are subtilisin enzymes manufactured and cultivated from special strains of spore forming bacteria, particularly Bacillus subtilis.

Proteolytic enzymes such as Alcalase, Maxatase, Protease AP, Protease ATP 40, Protease ATP 120, Protease L-252 and Protease L-423 are among those enzymes derived from strains of spore foaming bacillus, such as Bacillus subtilis.

Different proteolytic enzymes have different degrees of effectiveness in aiding in the removal of stains from textiles and linen. Particularly preferred as stain removing enzymes are subtilin enzymes.

Metalloproteases which contain divalent ions such as calcium, magnesium or zinc bound to their protein chains are of interest.

The production of various proteolytic enzyme concentrates is described in the patent literature: for example in German Offenlegenschrift No. 1,800,508 and in published Dutch patent application No. 6,815,944.

Instead of, or in addition to, the proteolytic enzyme, an amylase may be present such as a bacterial amylase of the alpha type (e.g. obtained by fermentation of B. subtilis). One very suitable enzyme mixture contains both a bacterial amylase of the alpha type and an alkaline protease, preferably in proportions to supply about 100,000 to 400,000 Novo alpha-amylase units per Anson unit of said alkaline protease.

The enzyme preparation may be incorporated as a powdered salt-containing product, or as a product containing little or no salt.

If desired the solution or suspension may be treated (desirably before any drying) to lighten its color, as by bleaching it with hydrogen peroxide or sodium hypochlorite.

The slurry to be sprayed may be formed in a crutcher (a mixing vessel equipped with a high speed stirrer) by adding the individual ingredients to water. The slurry may be passed through a grinding device to insure that it is a smooth and lump-free before spraying. The temperature of the heated evaporative gas introduced into the tower may be relatively low (e.g. in the range of 350°–450°F.) but higher temperatures (up to about 600°–700°F., for example) may be employed if desired. The temperature of the powder leaving the bottom of the spray tower may be relatively low, e.g. about 100°F, or it may be higher (e.g. 140°, 160° or 200°F.) particularly when the incoming evaporative gas is at a high temperature.

The crutcher mix from which the detergent beads are produced is an aqueous crutcher mix and for efficiency of operation it is preferred that the solids content be as high as feasible. This is usually from 40 to 75% solids, preferably 50 to 75% thereof; the balance is normally water.

Using such a crutcher mix, it is noted that the bulk density of the beads made is generally from 0.2 to 0.6 gram/cc. The bulk density is ordinarily not critical and generally may be determined by the cup weight at which the product will be employed.

The crutching of the detergent composition is effected by usual methods known in the art. Various apparatuses which may be employed are also known in the art, since the particular sparay drying and post-spraying steps not being of special criticality, a drawing is unnecessary in the present application. The crutcher mix will be heated to a temperature of about 90°–190°F., preferably 100°–150°F. and most preferably 100°–135°F., can be aerated (often preferable) and will be sprayed through spray drying nozzles at a pressure of about 200 to 2,000 lbs. per square inch to globular droplets which will pass through a drying gas, usually composed of products of the combustion of oil or gas, passing countercurrently with respect to the falling droplets. The drying gas is normally initially at a temperature of 150° to 350°C. though 350° to 340°F. and up to 700°F. as aforesaid are permissible. The droplet sizes from the spray drying nozzles will be such as to result in the desired particle sizes of the product, which will be substantially in the 6 to 200 or 6 to 140 mesh particle size range, preferably from 6 to 120 mesh, U.S. Standard Sieve Series, which is also the preferred size range of the final post-sprayed particles made. The particles may be screened to remove tailings and fines may be taken out before any post spraying of liquid ingredients onto the surfaces thereof. The moisture content of the product will normally be from 1 to 10%, generally from 1 to 6 or 7% and preferably about 5%. The dried particles resulting, which may be at a temperature of 80° to 160°F., usually from 90° to 130°F., shortly after the fall to the tower bottom, will be ready for post treatment with nonionic detergent or surface active agent and with other ingredients previously mentioned. When they are fresh and warm they are not excessively tacky and they may be post-sprayed with nonionics and other materials without agglomerating objectionably or becoming unacceptably tacky. The bulk densities of the spray dried beads, in the particle sizes range mentioned are in the 0.2 to 0.6 g./cc range.

The spray drying may be effected by forcing an aqueous slurry of the ingredients through a spray nozzle at the top of a spray tower into which heated evaporative gas such as air or flue gas is introduced. The gas may be introduced at the top of the tower to flow co-current with the sprayed material or into the lower part of the tower to flow counter-current. The composition is preferably dried to a total moisture content of about 1 to 3 to 5%. The moisture content can be determined readily by a conventional Cenco Moisture Tester (in which a predetermined weight of the dried composition of a balance pan is exposed to the heat of a hot electric lamp, situated at a predetermined distance from the sample, until the weight of the sample becomes constant, at which time the weight loss, due to evaporation of moisture, including water of hydration, is measured) or by conventional xylol distillation methods. The product is in the form of beads, such as small hollow spheroids which may be completely separate (and about 0.006 inch to 0.1 inch in diameter) or may form aggregates of such spheroids clumped together as unitary vesiculated structures having generally rounded smooth surfaces. The bulk density of the spray dried product may be, for example, in the range of about 0.3 to 0.4 or 0.6 g/cc. The particles may be treated with a suitable agent, (e.g. dusted with a small amount of colloidal silica) to improve their flowability, and may be packed, if desired, in containers having walls of low moisture transmissivity.

After production of the alkali metal dibasic acid spray dried beads, preferably those of 8 to 100 mesh and of a bulk density of about 0.2 to 0.6, the beads, either warm, as mentioned, or cooled, after storage, are sprayed with a finely divided spray of the nonionic surface active agent or detergent, usually at a temperature sufficiently elevated to liquefy the nonionic, e.g., 110° to 140°F., or in a solvent or plasticizing medium which accomplishes the same effect at a lower temperature.

The overspray is preferably of a polyethoxylated nonionic organic detergent, such as one of the Neodol type, and the total overspray which is utilized is such as to make the final content of such nonionic about 2 to 6% of the product, preferably about 5% thereof, for best pre-soak detergency. Overspraying is normally conducted in an agitated zone, to present new surfaces of the beads to the spray. It is found that the presence of soap and nonionic detergent, when present, in the spray dried bead does not inhibit the satisfactory overspraying and in fact, appears to assist it. The beads sprayed are substantially maintained in their original shapes and the nonionic is satisfactorily sorbed. In addition to the post-spraying with the nonionic detergent or surface active agent or mixture thereof, in the tumbling operation it is desirable to add anti-redeposition agent, perfume, sometimes sodium silicate, either as a solid or in solution, and a flow improving agent, such as that sold as Satintone, which is a calcined aluminum silicate.

After completion of the post spraying, the treated spray dried beads are removed from the mixer or tumbler apparatus utilized and if any oversize particles are present they may be screened out, size reduced or otherwise treated or recycled so as eventually to be in a desirable particle size range. The product made is free flowing, of a satisfactory bulk density, and is a pre-soak washing agent of good storage characteristics and satisfactory appearance.

The proportions of the various materials in the spray dried detergent beads before any post-spraying will normally be such that the alkali metal dibasic acid is from about 2–30% thereof, preferably 10 to 20% and most preferably about 15%, and any nonionic organic detergent, if present will be from 0.5 to 2%. The moisture content of the particles will generally be from 1 to 7%, preferably about 3. All or part of the nonionic may be replaced by anionic synthetic organic detergents and various of the other adjuvants previously mentioned. As was mentioned, the anti-redeposition agent will usually not be in the spray dried bead to an extent of over 0.5% and the content of sodium silicate will preferably be held to 2% and otherwise will be less than 3%, e.g., 0 to 3%, preferably about 2%. The anionic synthetic organic detergent content may be from 2 or 5 to 20% in a preferred embodiment.

The following examples illustrate the invention but do not limit it. Unless otherwise mentioned, all parts, proportions and ratios are by weight therein and in the appended claims and all temperatures are in °F.

EXAMPLE 1

| | Pounds |
|---|---|
| Water | 114 |
| Sodium sulfate | 341 |
| Aqueous sodium silicate solution 43.5% solids ($Na_2O:SiO_2$ = 1:2.35) | 12.5 |
| Tridecyl Benzene sulfonate | 114 |
| Adipic acid | 67 |
| 50 Be caustic | 74 |

The above crutcher mix is prepared in a commercial heated detergent crutcher and prior to the addition of the nonionic, the previously made mix of water, adipic acid, caustic, sodium sulfate dissolved in the water, and silicate is heated to 135°F., after which the nonionic surface active compound is added and the temperature is maintained. Suitable adjuvants may also be added in the crutcher, for example, optical bleaches, antimicrobial compounds, colorants. After sufficient mixing, which takes about 5 to 15 minutes, the heated fluid crutcher mix, with air injected into it just before spraying, at the rate of 15 to 20 cubic feet per minute, to regulate spraying properties, is spray dried. The crutcher mix is pumped to conventional tower spray nozzles by a high pressure pump at a pressure of about 660 lbs./sq. in. gauge. The inlet air temperature to the countercurrent spray drying tower is about 600°F. and the outlet temperature of the drying air is about 135°F. Spray drying of the crutcher mix takes about 11 minutes and seven crutcher batches are made. The bead produced has a moisture content of 2–4%; a density of 0.5 g/ml. a flow rating of 60–75% (excellent flow) and is non-tacky.

Onto the spray dried beads, being tumbled in a tumbling drum, additional nonionic detergent is sprayed. The spraying technique employed is that known in the art. The final product made has a density like that of the starting beads, a flow rate of 65% (very good) and is non-tacky.

Similar products can be made, excluding the nonionic from the base bead and instead employing only an anionic. Omission of the nonionic from the crutcher mix does not have a significant effect.

The detergent produced by the present invention is ecologically acceptable, since it contains no phosphates. It also may be manufactured without anionic synthetic organic detergent. The formulation is for a non-sudsing laundry pre-soak product, which type of detergent is preferred for removing tough stains.

EXAMPLE 2

Crutcher mixes are made and post-additions of various components are effected, following the method of Example 1, with the changes indicated, so as to obtain final products of the following formulas:

| | Percent | | | |
|---|---|---|---|---|
| | A | B | C | D |
| Water | 1 | 4 | 1 | 2 |
| Sodium silicate, aqueous solution ($Na_2O:SiO_2$ = 2.4, solids contents = 43.5%) | 1 | 2 | 1 | 1 |
| Soap (80:20 tallow:coco) | 1 | 1 | 1 | 2 |
| Nonionic detergent (Neodol 45-11, added in crutcher) | 0 | 1 | 2 | 0 |
| Nonionic detergent (Neodol 25-7, post added) | 5 | 4 | 3 | 5 |
| Perfume (post-added) | 0.2 | 0.2 | 0.2 | 0.2 |

The crutcher mix, at 135°F., is pumped by a Triplex pump at a pressure of 200–600 lbs./sq. in., gauge, through a nozzle into drying air entering at 475°F. and leaving the countercurrent spray tower at 140°F. The products resulting have particle sizes of 6 to 200 mesh and bulk densities in the 0.2 to 0.5 g/ml. range in most cases and when such density is slightly higher, it is depressed by the addition of more soap to the crutcher mix.

When Neodol 45-11 is replaced with other surface active nonionic compounds, good results are also obtained. In such cases the nonionic is also sprayable at elevated temperatures, e.g., 140°F., and the beads to which it is applied may be warm from the tower, e.g., at 140°F. When the tallow-coco soap mix is replaced by commercial stearic acids (double- or triple pressed) or by pure palmitic or stearic acid, excellent products may also be obtained.

In the following Examples the disulfonate is, unless otherwise indicated, a powder containing 54% active ingredient, 42% sodium sulfate, about 3.4% water and about 0.6% unsulfonated water-insoluble material. The active ingredient includes the sodium salts of both the alkyl phenol disulfonate and alkyl phenol monosulfonate. The alkyl chain length is 18 to 20 carbon atoms.

When proportions are stated as "A.I." those proportions represent the amount of the active ingredient of the abovedescribed powder; thus "15% A.I. of the alkyl phenol disulfonate" means that a sufficient amount of the powder is used to supply a total of 15% of the active ingredient of that powder; since the active ingredient constitutes 54% of the powder the amount of the powder that is employed to supply 15% A.I. is about 28% (that is, 15% divided by 0.54).

EXAMPLE 3

A group comprising swatches of stained cotton cloth, swatches of stained cotton-polyester wash-and-wear cloth is pre-soaked in a composition as described in Example 1 except that the anionic therein is replaced by a 25% A.I. of the phenol disulfonate.

The stained cloths include individual swatches (of each type of fabric) stained with barbecue sauce, spaghetti sauce, strained cooked spinach, beef blood, chocolate pudding, and chocolate bar.

A further improvement in stain removal is obtained by including a proteolytic enzyme or an amylase, or both, the enzyme being of the type which exhibits its optimum activity at a pH about neutral, e.g. in the range of pH 7–9. Specifically, there is included 0.6% of Monsanto's Monzyme AP SG2241 which is an enzyme composition obtained from a bacillus subtilis culture and having an assay of 1.2 million Monsanto units of protease when measured at pH 7 and 0.3 million Monsanto units of protease when measured at pH10, as well as 0.34 million Monsanto units of amylase (measured at pH6).

The composition of this Example may also contain an anit-redeposition agent (such as 0.5% of carboxymethyl cellulose). It may also contain brighteners such as those previously listed.

It is also within the broad scope of this invention to use any of the surfactants described herein in admixture with proteases (such as those previously mentioned herein). For compositions having a pH in the wash water of about 9 suitable types of proteases are those which are of the serine type, are produced by culture of the genus bacillus and show optimum proteolytic activity against hemoglobin at a pH value of about 9. Such enzymes may be added to any of the compositions broadly disclosed above or to any of the compositions specifically described. The proportion of such proteases may be such as to provide about 0.05 to 1.5 (preferably in the range of about 0.1 to 0.8) Anson units (measured at its pH of maximum activity) per 100 grams of detergent composition. Particularly suitable enzymes are disclosed in published German application (Offenlegunschrift) No. 1800508 and especially the enzyme designated therein as C372. The enzyme may be in suitable non-dusty form, such as the sperical beads formed by blending the enzyme with molten detergent and thereafter spray drying to form beads containing, say about 1/10 to 3 or more Anson units per gram of beads.

EXAMPLE 4

Example 3 is repeated except that the enzyme described as C372 is added, in proportion to provide about 1 Anson unit per 100 grams of total detergent composition, the enzyme being added as substantially non-dusting spherical beads formed by spraying droplets of a blend of the enzyme and molten detergent.

EXAMPLE 5–6

Example 3 is repeated except that the enzyme described as C372 is added, in proportion to provide about 1 Anson unit per 100 grams of total detergent composition, the enzyme being added as substantially non-dusting spherical beads formed by spraying droplets of a blend of the enzyme and molten detergent.

Although the present invention has been described with reference to particular embodiments and examples, it will be apparent to those skilled in the art that variations and modifications can be substituted therefore without departing from the principles and true spirit of the invention.

It is to be understood that in carrying out the instant invention, one may employ the acid per se together with a stoichiometric amount of base to neutralize same, and to form the acid salt therefrom. Any suitable metal base may be employed, particularly the alkali metal bases, and most particularly NaOH. Where NaOH is employed, it is added at 50 Be.

We claim:

1. A spray dried, nonphosphate detergent bead composition post treated with a liquid spray containing polyethoxylated nonionic organic detergent in an amount of from about 3 to about 5 percent by weight, the base spray dried bead composition consisting essentially of, approximately by weight, a. 5–25% of an alkali metal salt of a dibasic acid selected from the group consisting of oxalic, malonic, succinic, glutaric, adipic, pimelic,, suberic, azelaic and sebacic acids, b. up to 35% of 1. anionic soap or synthetic organic sulfated or sulfonated detergent, 2. zwitterionic, or 3. amphoteric detergent material, c. 0 to 2% of said nonionic detergent, d. 0 to 7% of an alkali metal silicate, e. the balance being sodium sulfate, said final detergent bead composition containing up to about 6 percent of said nonionic detergent, and said final composition being adapted to yield in aqueous solution a pH of about 7 to 9.

2. A composition as defined in claim 1 wherein component (d) is included in amounts of 0.1 to 2%.

3. A composition as defined in claim 1 wherein component (a) is a double salt.

4. A composition as defined in claim 1 wherein component (a) is the sodium salt of said dibasic acid.

5. A composition as defined in claim 1 wherein said acid of component (a) is adipic acid.

6. A composition as defined in claim 1 wherein component (a) is included in amounts of 8 to 18%.

7. A composition as defined in claim 1 wherein component (b) is included in amounts of 5–20%.

8. A composition as defined in claim 1 wherein component (d) is present in amounts of 0.5 to 4%.

9. A composition as defined in claim 1 wherein component (c) includes about 0.5 to about 2% of a non-ioni non-ionic

10. A composition as defined in claim 1 wherein component (b) is an alkyl aryl sulfonate.

11. A composition as defined in claim 1 further containing up to about 0.6% of an enzymatic agent in said base spray dried bead composition.

12. A composition as defined in claim 11 wherein said enzymatic agent is a proteolytic enzyme.

13. A method of preparing the composition as defined in claim 2 comprising admixing components (a), (b), (c), (d) and (e), spray drying same to form a bead and thereafter treating the resulting beads with a liquid spray of said detergent non-ionic.

14. A method as defined in claim 13 wherein said components are admixed in a crutcher mix containing about 40 to 75% solids.

15. A method as defined in claim 13 wherein said crutcher mix is at a temperature of about 90°–190°F. before spraying.

16. A method as defined in claim 13 wherein the crutcher contains component (c) in amounts of from 0.5 to 2%.

17. A method as defined in claim 13 wherein the crutcher mix contains components (b) and (a) in such proportions as to result respectively in 2 to 20% and 10 to 20% thereof in the spray dried beads.

18. A composition as defined in claim 1 comprising approximately by weight 8 to 18% component (a), 2 to 20% component (b), 0.5 to 4.0% component (d).

* * * * *